United States Patent [19]

Brauss

[11] 3,949,469

[45] Apr. 13, 1976

[54] ELECTRIC SHAVER COMPRISING A ROTATABLE CYLINDRICAL SHEARING FOIL

[75] Inventor: Helmut Balthasar Brauss, Kronberg, Germany

[73] Assignee: Braun Aktiengesellschaft, Frankfurt am Main, Germany

[22] Filed: Feb. 19, 1974

[21] Appl. No.: 443,859

[30] Foreign Application Priority Data

Feb. 16, 1973 Austria ..... 1385/73

[52] U.S. Cl. ..... 30/43.91; 30/43.4

[51] Int. Cl.[2] ..... B26B 19/02

[58] Field of Search ..... 30/43.91, 43.92, 43.4, 30/42, 217, 219, 46, 346.51

[56] References Cited

UNITED STATES PATENTS

| | | | |
|---|---|---|---|
| 432,432 | 7/1890 | Palmer | 30/219 |
| 2,302,941 | 11/1942 | Frey | 30/43.92 |
| 2,318,351 | 5/1943 | Alexay | 30/42 X |
| 2,363,849 | 11/1944 | Bailey | 30/43.92 X |
| 2,526,153 | 10/1950 | Page | 30/43.91 |
| 2,802,261 | 8/1957 | Heyek | 30/43.92 |
| 3,037,281 | 6/1962 | Arey | 30/43.4 |
| 3,802,073 | 4/1974 | Braun et al. | 30/43.92 |

FOREIGN PATENTS OR APPLICATIONS

| | | | |
|---|---|---|---|
| 625,928 | 8/1961 | Canada | 30/43.91 |

*Primary Examiner*—Al Lawrence Smith
*Assistant Examiner*—Robert C. Watson
*Attorney, Agent, or Firm*—Frederick E. Bartholy

[57] ABSTRACT

An electric shaver construction is described having a cylindrical, rotatable shearing foil adapted to roll over the surface to be shaved. Disposed within the cylindrical foil is a cutting head moved by a motor to oscillate in the direction axial to said foil.

5 Claims, 9 Drawing Figures

Fig.7
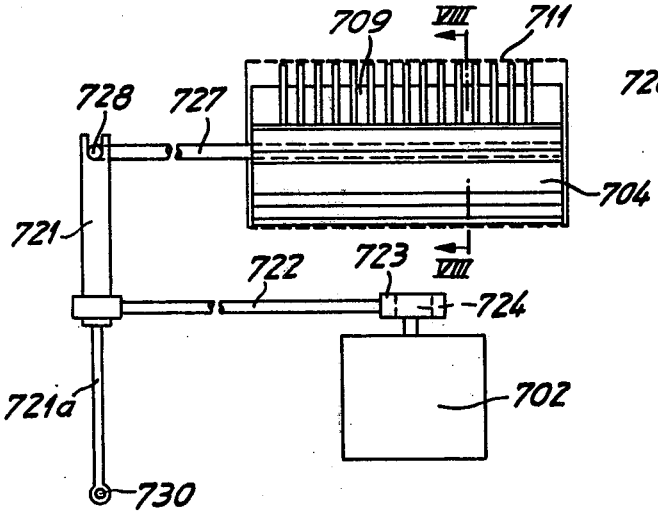
Fig.8
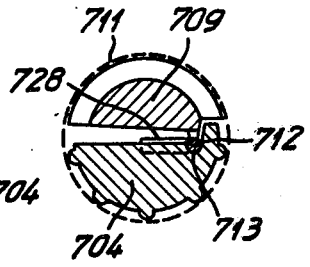
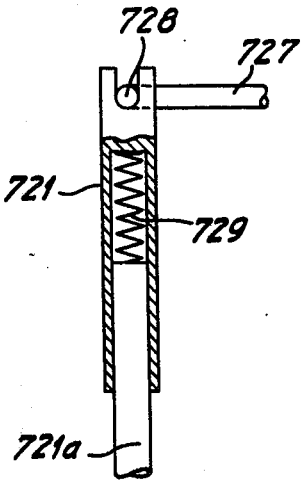
Fig.9

ELECTRIC SHAVER COMPRISING A ROTATABLE CYLINDRICAL SHEARING FOIL

The invention relates to an electric shaver comprising a rotatable cylindrical shearing foil inside which a blade head is reciprocably arranged.

In a known electric shaver of this type the blade head extends over the entire inner surface of the shearing foil. It has been found that such a construction affords an unnecessarily high power consumption to move the blade head because the latter also bears against the shearing foil at areas which do not serve for cutting hairs. In addition, the known construction is rather voluminous.

The problem underlying the invention is to provide an electric shaver of the type mentioned above which requires relatively low drive power and may be constructed in compact form.

The solution of this problem is to be substantially in that the blade head extends only over a portion of the inner surface of the shearing foil, that in the region of the shearing foil not covered by the blade head at least one support member for the shearing foil is arranged, that the blade head is supported resiliently on the support member and that the blade head is provided with a coupling device for the drive connection to a drive motor.

According to a special embodiment the support member is formed by a member curved at the underside and comprising at its upperside bearing surfaces adapted to movably support the blade head.

According to a further preferred embodiment the blade head is articulately connected at one longitudinal edge to the support member and at the other longitudinal edge is supported by said member and is urged against it by pressure springs.

Alternatively, magnets having their identical poles opposite each other may be attached to the blade head on the one hand and the support member on the other hand instead of providing pressure springs.

According to another alternative embodiment in the region of one longitudinal edge the blade head is articulately connected to a support member and is mounted on a bar which at a point lying outside the articulation axis is coupled via a spring bias means to an oscillatingly driven member.

The invention will be additionally explained hereinafter with reference to schematic drawings of some preferred embodiments.

FIG. 7 is a side elevation partially in longitudinal section of a further embodiment of an electric shaver according to the invention.

FIG. 8 is a cross-section along the line VIII—VIII of FIG. 7.

FIG. 9 shows a detail of the drive connection.

In the drawings, the first digit of the reference numerals refers to the Figure and the two last digits denote the components, the same components being designated with the same reference numerals.

Figure 1:
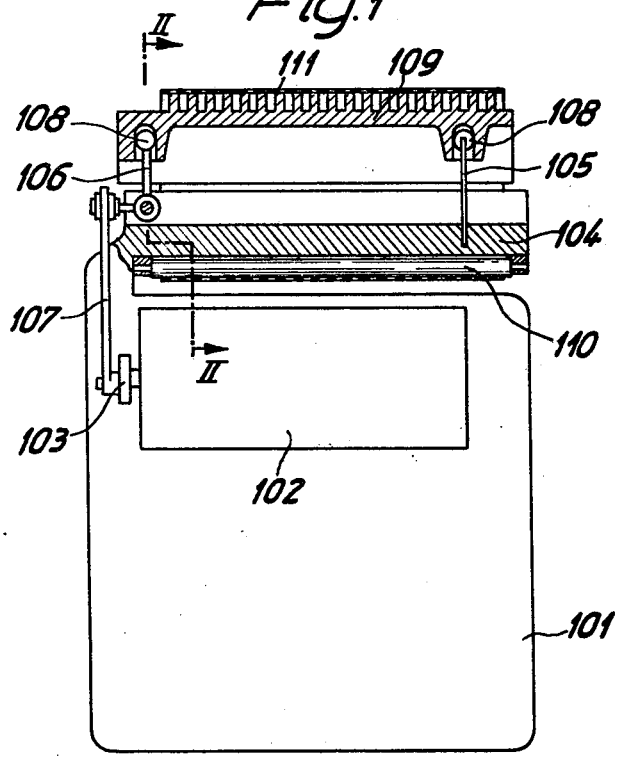
FIG. 1 is a partially sectioned side elevation of an electric shaver according to the invention.
Figure 2:
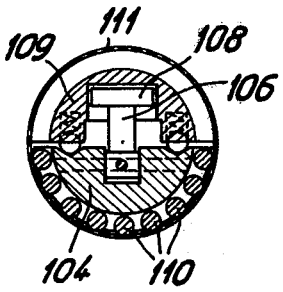
FIG. 2 is an end view along the line II—II of FIG. 1.

The electric shaver according to FIGS. 1 and 2 includes a housing 101 in which a drive motor 102 is accommodated. The shaving head is arranged above the drive motor and includes a holding member 104 which is cylindrically curved and fixedly connected at one end to the housing. Clamped at one end of the holding member 104 is a holding spring 105 and at the other end a pivotable cantilever 106 is articulately attached, the shorter arm thereof being articulately connected to a coupling rod 107 which is connected with its other end to the crank disc 103.

Mounted on the free ends of the holding spring 105 and the cantilever 106 are cylindrical bearing pins 108 which engage in correspondingly shaped recesses at the underside of a blade head 109 which has the form of a cylinder halved along the axis. At the underside of the holding member 104 there are a plurality of biasing rollers 110 which are rotatably mounted on the holding member.

A cylindrical shearing foil 111 which is freely rotatable but axially immovable is positioned round the blade head 109 and the biasing rollers 110.

When the drive motor 102 is energized the cantilever 106 is performing an oscillatory movement via the crank disc 103 and the coupling rod 107, and the blade head 109 performs a corresponding movement. Since the shearing foil is held immovable in this direction the blade head executes a relative motion with respect to said foil. However, during shaving the shearing foil 111 can rotate freely so that it rolls along the skin and gives a pleasant shave.

Since the holding member 104 is connected only on one side to the housing, the foil 111 may be easily withdrawn towards the other side and the blade head 109 then lifted off the bearing pins 108 to permit easy cleaning of the appliance.

Figure 3:
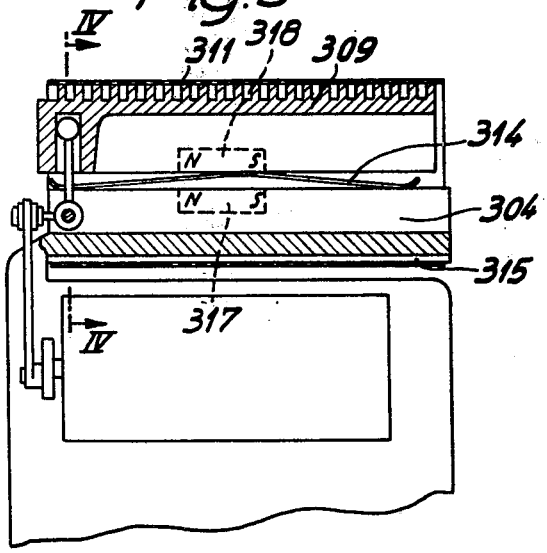
FIG. 3 is a partially sectioned side elevation of a modified embodiment of an electric shaver according to the invention.

FIG. 3 shows an embodiment of an electric shaver modified with respect to FIG. 1. The blade head 309 is provided along one longitudinal edge with a cylindrical rib 312 serving as a bearing rib, and the holding member 304 is provided in the region adjacent said rib with a complementarily shaped bearing groove 313. Provided in the region of the opposite longitudinal edge is a pressure spring 314 which ensures that the blade head 309 and the holding member 304 are pressed with their outer surfaces against the shearing foil 311.

Instead of the biasing rollers 110 provided in the embodiment of FIG. 1 longitudinal ribs 315 are provided which consist of a material having a low coefficient of friction.

The drive is effected in the same manner as in the electric shaver according to FIG. 1 and thus need not be described in detail.

Figure 5:
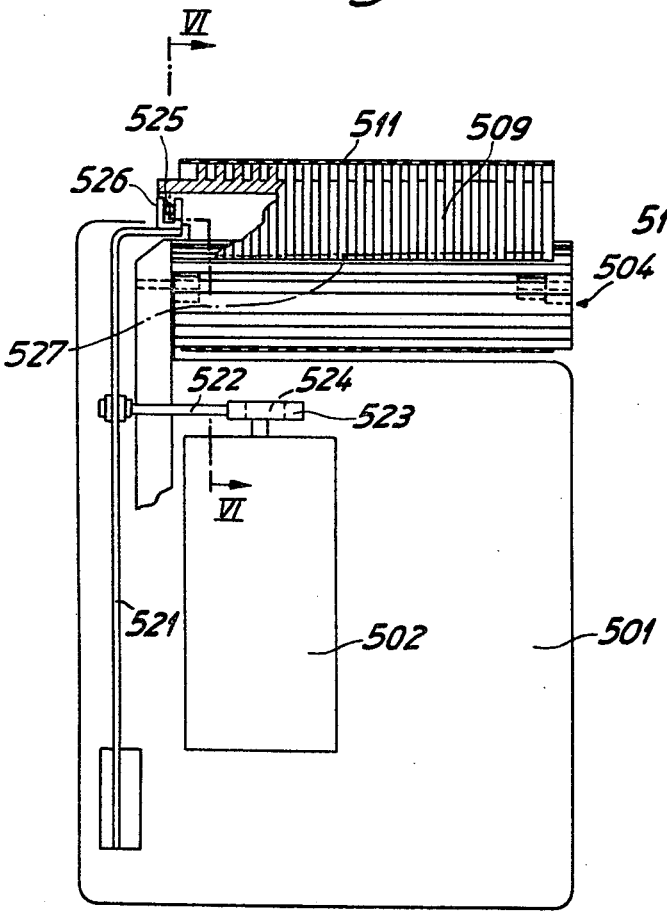
FIG. 5 is a partially sectioned side elevation of a further embodiment of an electric shaver according to the invention.
Figure 6:
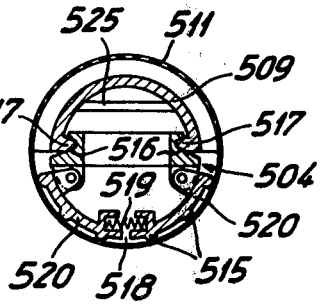
FIG. 6 is a cross-section along the line VI—VI of FIG. 5.

FIGS. 5 and 6 show a further embodiment of an electric shaver wherein the holding member 504 comprises at its upper side dovetail guide grooves 516 into which engage guide ribs 517 which are formed on the underside of the blade head 509. The outer surface of the holding member 504 is provided with longitudinal ribs 515 which are formed similarly to the longitudinal ribs 315 of FIG. 3. It is expedient to make the guide grooves 516 and the guide ribs 517 helical as indicated by the dashed line 527 in FIG. 5 so that the blade head executes a rolling motion in operation.

The holding member 504 is slit along a separation 518 and a pressure spring 519 is inserted into said separation and ensures that the blade head 509 and the holding member 504 are biased against the shearing foil 511. However, instead of providing the pressure spring 519 the two legs 520 of the holding member 504 may be made resilient, for example from plastic, in which case of course the two articulations between the legs 520 and the holding member 504 are not necessary. The spring action of the legs may be increased by embedded steel springs.

The blade head 509 is driven via a spring lever 52 fixedly mounted at one end with its free end articulately connected to the blade head. Articulately connected in the upper region of the spring lever 521 is a crank rod 522 which merges into an annular member 523 which runs on an eccentric disc 524 mounted on the shaft of the drive motor 502.

The shearing foil 511 is freely rotatable but axially immovable as in the previously described embodiments.

Instead of the pressure springs magnets may also be used to produce repellent forces. The spring 314 in FIG. 3 may for example be replaced by two magnets 317 and 318 which are accomodated in the blade head 309 on the one hand and the holding member 304 on the other hand and identical poles of which face each other. These magnets are illustrated in dashed line in FIG. 3.

To cancel the repellent force, for instance for changing a shearing blade, the lower magnet 317 may be axially displaceable so that opposite poles of the two magnets face each other.

Figure 4:
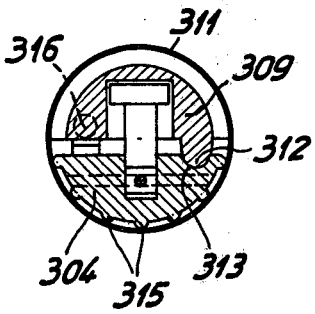
FIG. 4 is a cross-section along the line IV—IV of FIG. 3.

FIG. 7 shows an electric shaver according to the invention in which as in the embodiment according to FIGS. 3 and 4 the blade head 709 is mounted in a support member 704 in a longitudinal groove 713 thereof in which rests a cylindrical cup 712 which is mounted on the blade head 709 and merges into a bar 727 which is bent at its end at right angles to a coupling member 728 which engages in a two-part lever 721 and 721*a* which is mounted at one end, the part 721 being made hollow in accordance with FIG. 9 and containing a pressure spring 729 which engages on the free end of the part 721*a* which is articulately mounted at the point 730.

The spring 729 presses the part 721 of the lever against the portion 728 which exerts a torsional moment on the bar 727 and thus on the blade head 709 so that the latter is pressed against the inside of the shearing foil 711.

The movement of the lever 721, 721*a* is effected in the same manner as in the electric shaver according to FIG. 5, i.e. via a crank rod 722 which merges into an annular member 723 which runs on an eccentric disc 724 mounted on the shaft of the drive motor 702.

I claim:

1. An electric shaver including a cylindrical shearing foil, a first support for rotatably supporting said foil, a blade head arranged inside of said shearing foil and extending over a portion of the circumference thereof, a second support arranged inside said shearing foil, a pressure exerting means acting between said cutting head and said second support means, and contact means arranged over a part of the circumference of said second support means facing said shearing foil providing contact areas against which the inside of said shearing foil abuts, and bearing means between said second support and said blade head for reciprocal movement of said head with respect to said second support.

2. A shaver in accordance with claim 1, wherein said contact means comprises a plurality of rollers disposed around the periphery of said second support means.

3. A shaver in accordance with claim 1, wherein said contact means comprises a plurality of ribs placed in an axial direction of said second support means.

4. A shaver in accordance with claim 1, wherein said second support means comprises at least two pivotable elements pivoted coaxially to the axis of said shearing foil and wherein said pressing exerting means comprises at least a pressure spring arranged between said elements in a direction transverse to said pivotal axis.

5. An electric shaver construction, including a horizontally disposed cylindrical support, a plurality of rollers rotatably disposed on the underside of said support, a cylindrical shearing foil enclosing said support, said foil being rotatably disposed over said rollers, a blade head engaging an area of the inner surface of said foil, said head being held at one end by a tension spring vertically extending from said support, and at the other end by a vertically extending pivotal lever having a lateral extension, a bar connecting said extension with a crank disk affixed to the shaft of a drive motor whereby, upon operation of said motor, said blade head oscillates in the axial direction of said rotating foil.

* * * * *